US005351667A

United States Patent [19]

Mori et al.

[11] Patent Number: 5,351,667

[45] Date of Patent: Oct. 4, 1994

[54] FUEL TANK PRESSURIZING APPARATUS

[75] Inventors: Shigemi Mori; Hitoshi Akagi, both of Okayama, Japan

[73] Assignee: Kaaz Corporation, Okayama, Japan

[21] Appl. No.: 84,308

[22] Filed: Jun. 29, 1993

[30] Foreign Application Priority Data

Jul. 3, 1992 [JP] Japan ..... 4-176646

[51] Int. Cl.[5] ..... F02M 37/04

[52] U.S. Cl. ..... 123/510; 123/317

[58] Field of Search ..... 123/317, 73 AF, 532, 123/533, 534, 510

[56] References Cited

U.S. PATENT DOCUMENTS

| | | | |
|---|---|---|---|
| 582,073 | 5/1897 | Mead | 123/532 |
| 583,399 | 5/1897 | Lewis | 123/532 |
| 1,351,880 | 9/1920 | Thompson | 123/73 AF |
| 1,424,486 | 8/1922 | Kinzie | 123/510 |
| 2,059,005 | 10/1936 | Lane | 123/510 |
| 2,794,431 | 6/1957 | Ginnow | 123/510 |
| 3,672,172 | 6/1972 | Hammond | 123/317 |

*Primary Examiner*—Carl S. Miller
*Attorney, Agent, or Firm*—Koda and Androlia

[57] ABSTRACT

This invention has an object to provide a fuel pressurizing apparatus which is light, compact, durable and inexpensive whereby a working machine can be operated even on a slope without difficulty. In order to achieve this object, a pressure adjusting chamber is formed in a portion of a passage in a breather device of an engine, and a pipe conduit is provided to communicate the pressure adjusting chamber with a fuel tank. A check valve which does not allow fuel from the fuel tank to pass is provided in a portion of this pipe conduit. A vent hole which is constantly open is provided in the fuel tank, and a cross-sectional area of the vent hole is set to maintain balance of a pressure from the pressure adjusting chamber with a pressure required for the fuel tank. A space is formed in an upper portion of the fuel tank so as to project therefrom. The fuel tank is shaped like a triangular flask, and the pipe conduit from the pressure adjusting chamber is connected to the projecting space in the upper portion of the fuel tank. Thus, the fuel tank pressurizing apparatus can be operated more reliably.

4 Claims, 5 Drawing Sheets

LIQUID LEVEL OF FUEL TANK
HEAD OF LIQUID LEVEL (+)
THE LOWEST POINT OF LIQUID LEVEL OF CARBURETOR
3
30
23

THE LOWEST POINT OF LIQUID LEVEL OF CARBURETOR
30
3
HEAD OF LIQUID LEVEL (−)
LIQUID LEVEL OF FUEL TANK
23
INCLINED ANGLE OF ENGINE

FUEL TANK PRESSURIZING APPARATUS

BACKGROUND OF THE INVENTION

1. Industrial Field of the Invention

The present invention relates to a pressurizing apparatus of a fuel tank and, more particularly, to a pressurizing apparatus of a fuel tank in such a machine as a working machine or vehicle on which a four-cycle engine or the like is mounted and in which the positional relation between the engine and the fuel tank changes.

2. Description of the Prior Art

In the case of a four-cycle engine, a fuel pump provided on an automobile or the like is generally known as an apparatus for pressurizing fuel. However, most of agricultural working machines such as mowers are of the type in which a fuel tank is located at a higher position than an engine so that fuel drops naturally and is supplied to the engine. For example, this type of apparatus are disclosed in U.S. Pat. Nos. 4,212,364 and 4,422,283. In such a case, the positional relation between a carburetor and the fuel tank in the direction of their heights is an important factor of the fuel supply capacity.

In this manner, when a four-cycle engine does not include the above-mentioned fuel pump, the positional relation between a carburetor and a fuel tank in the direction of their heights is an important factor of the fuel supply capacity. However, when the four-cycle engine is inclined during operation, this positional relation directly affects its performance on a slope.

For example, an automotive mowing machine of radio control type is the most effective when it is used for operation on a slope which has a large operational load and is highly dangerous. River banks are inclined at an angle of about 30 degrees in general, and some of the rough in golf links has an inclination as large as 50 degrees. However, fuel supply in a four-cycle engine employed at present can be conducted only when the inclination is 25 to 30 degrees at the maximum. Therefore, a fuel pump is indispensable for an engine of a machine which is operated on a steep slope, as described above. However, when the fuel pump is mounted, the machine becomes accordingly large in size and weight although a working machine, especially a working machine for steep-slope operation, is strongly demanded to be light and compact.

Taking such a problem into consideration, the present invention has an object to provide a fuel pressurizing apparatus which is light, compact, durable and inexpensive whereby a working machine can be operated even on a slope without any difficulty.

SUMMARY OF THE INVENTION

The present invention solves the above-described problem by pressurizing a fuel tank without a fuel pump. As a result of various investigations, one part of a breather device and a pressure in the breather device are utilized for pressurizing the fuel tank in this invention. More specifically, a pressure adjusting chamber is formed in a portion of a passage in the breather device, and a pipe conduit is provided to communicate the pressure adjusting chamber with the fuel tank.

Depending on a shape, a location and operating conditions of the fuel tank, fuel might flow into the pressure adjusting chamber through the pipe conduit from the fuel tank. Consequently, a check valve which does not allow fuel from the fuel tank to pass is provided in a portion of the pipe conduit communicating the pressure adjusting chamber with the fuel tank.

In order to prevent an excessive pressure increase owing to heating of the fuel tank or such factors, a vent hole which is constantly open is provided in the fuel tank, and a cross-sectional area of the vent hole is set to maintain balance of a pressure from the pressure adjusting chamber with a pressure required for the fuel tank.

Further, in order to decrease an amount of the fuel which flows into the pressure adjusting chamber, the fuel tank has a substantially triangular shape, and a vertically elongated space is formed in an upper portion of the fuel tank so as to project from the tank vessel, with the pipe conduit from the pressure adjusting chamber being connected to this space.

With the above-described structure where the breather device which has been conventionally provided in the four-cycle engine is utilized, the fuel tank can be pressurized without losing energy and using a complicated pump.

Since the check valve which does not allow fuel from the fuel tank to pass is provided in the portion of the pipe conduit to the fuel tank, fuel is prevented from flowing into the pressure adjusting chamber from the fuel tank, depending on the shape, location and operating conditions of the fuel tank.

Moreover, the vent hole which is constantly open is provided in the fuel tank, and the cross-sectional area of the vent hole is set to maintain balance of the pressure from the pressure adjusting chamber with the pressure required for the fuel tank. Therefore, it is possible to prevent an excessive pressure increase owing to heating of the fuel tank or such factors, and to pressurize the fuel tank constantly reliably.

Furthermore, the fuel tank has a substantially triangular shape, and the projecting space is formed in the upper portion of the fuel tank, with the pipe conduit from the pressure adjusting chamber being connected to this projecting space. Thus, the fuel is prevented from flowing into the pressure adjusting chamber.

DETAILED DESCRIPTION OF THE INVENTION

A fuel tank pressurizing apparatus according to the present invention which is provided on a four-cycle engine mounted on an automotive mowing machine of radio control type will be hereinafter described as one embodiment.

Figure 2:
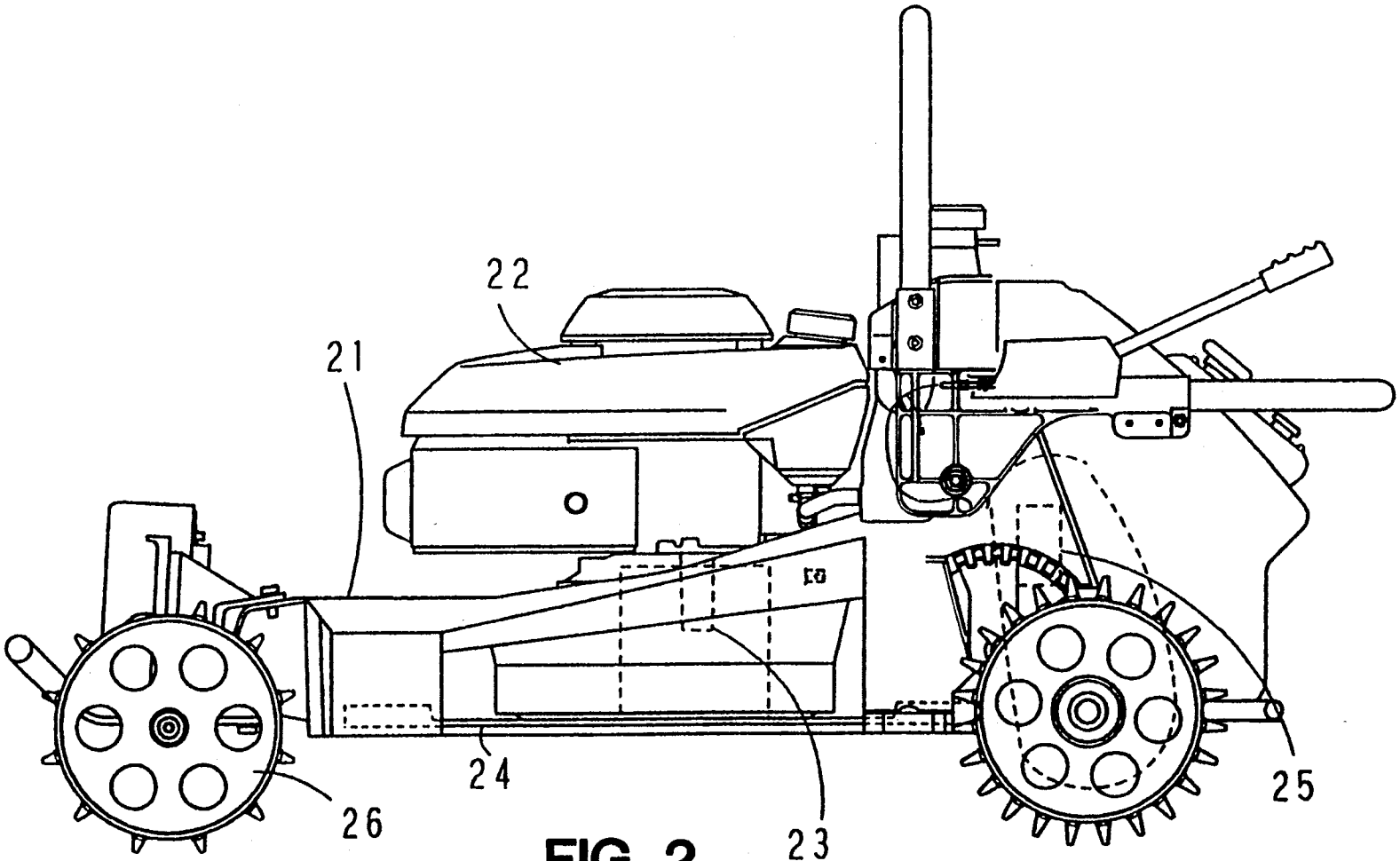
FIG. 2 is a side view of an automotive mowing machine of radio control type.

FIG. 2 is a side view of the radio-control automotive mowing machine. A cutter 24 is attached on a lower end of an output shaft 23 of the four-cycle engine 22 which is mounted on a carriage 21, and a traveling transmission and steering wheels 26 are operated by signals from a radio receiver 25. The fuel tank pressurizing apparatus of the following structure is provided on this radio-control automotive mowing machine.

Figure 1:
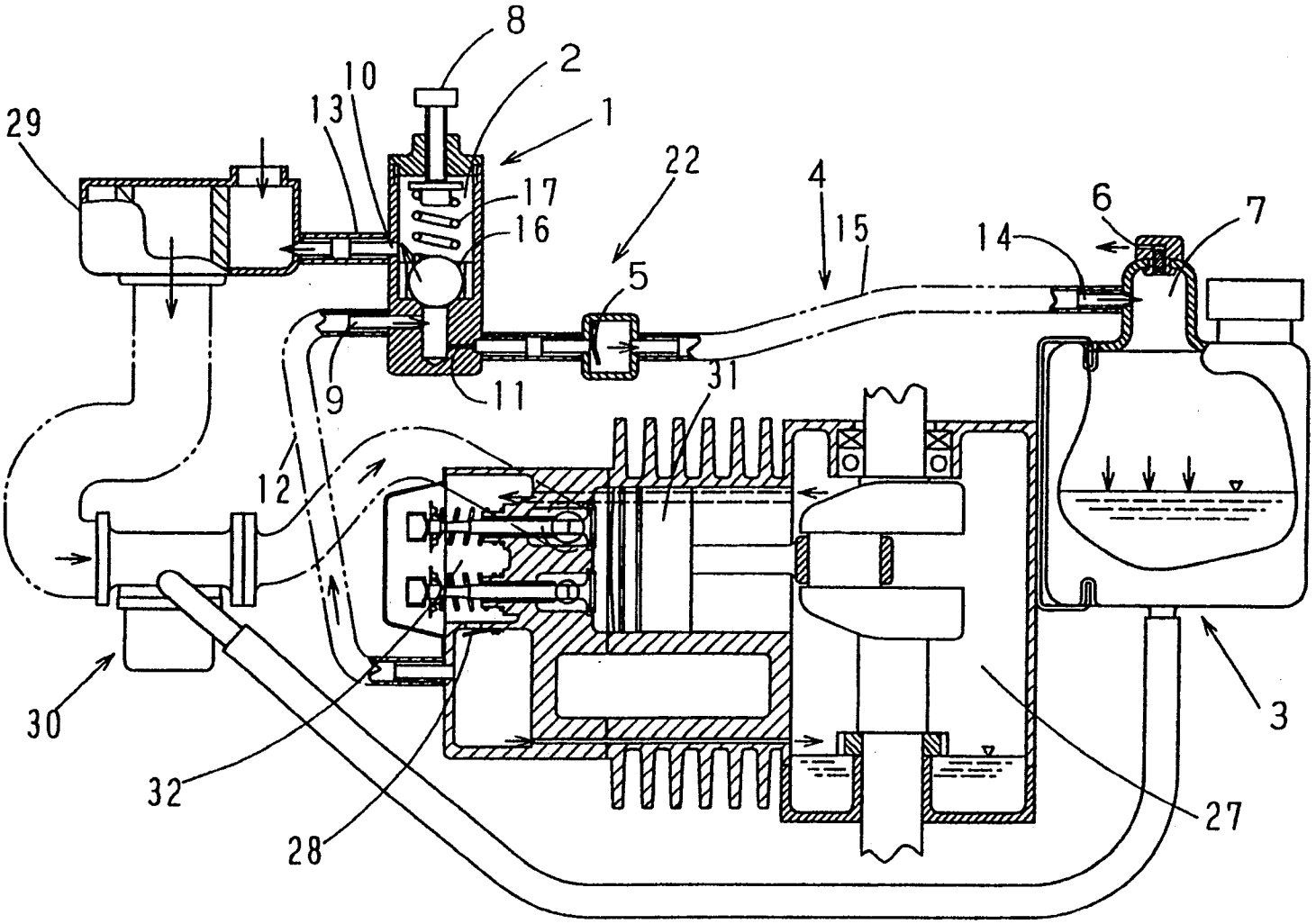
FIG. 1 is a passage diagram showing one embodiment of a breather device of a four-cycle engine according to the present invention.

A breather device of the four-cycle engine constitutes, for example, as shown in FIG. 1, a passage for communicating a crank chamber 27 and a tappet chamber 32 and circulating the air from an air cleaner 29 to a carburetor 30 via a check valve 28 in the tappet chamber.

Figure 4:
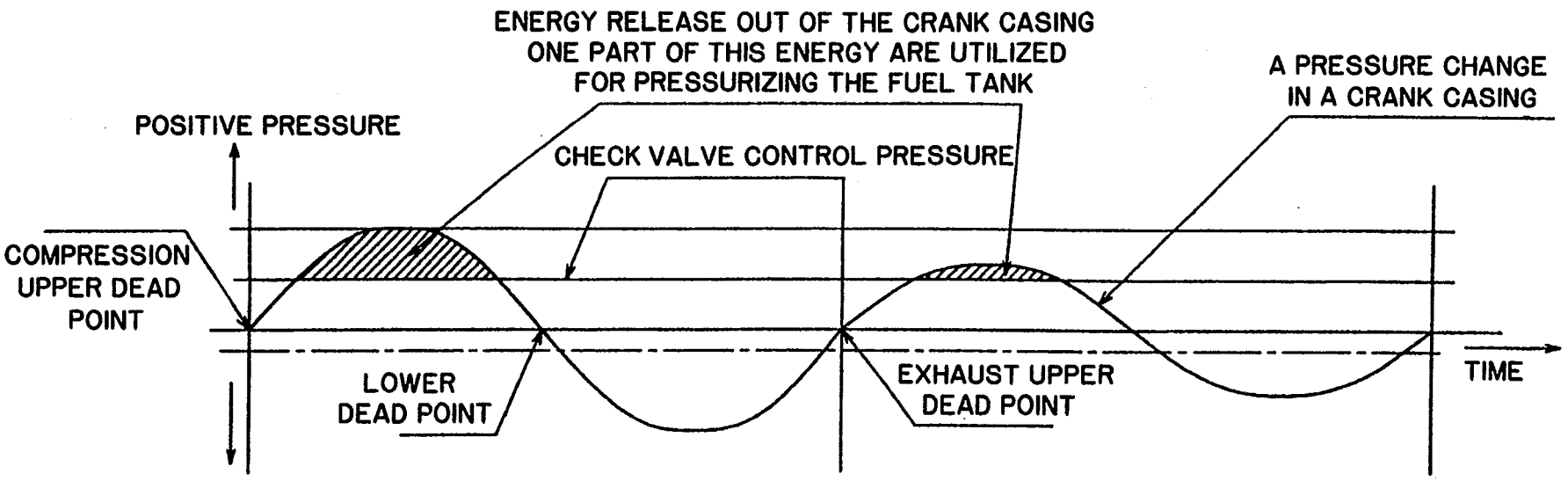
FIG. 4 is a graph illustrative of a pressure change in a crank casing.

FIG. 4 is a graph illustrative of a pressure change in a crank casing owing to operation of the breather device. By the check valve 28 in the tappet chamber, energy indicated by shadowed portions of the graph is released out of the crank casing via the air circulation passage of the breather device. Therefore, the pressure in the air circulation passage is repeatedly varied from positive to negative pressure and from negative to positive pressure with respect to the atmospheric pressure mainly by the movement of a piston 31.

In the present invention, a pressure adjusting chamber 2 is provided in the breather device 1 which is installed in a portion of the air circulation passage. More specifically, the pressure adjusting chamber 2 is defined by a valve ball 16, a spring 17, a pressure adjusting bolt 8, a suction port 9 of the air from the tappet chamber 32, a discharge port 10 to the air cleaner 29, a discharge port 11 to a fuel tank 3, and so forth. The suction port 9 of the pressure adjusting chamber 2 is connected to a pipe 12 to the tappet chamber, and the discharge port 10 is connected to a pipe 13 to the air cleaner. Also, the discharge port 11 is connected to a pressurizing port 14 of the fuel tank 3 by a pipe C 15, thereby forming a pipe conduit 4. The pipe conduit 4 communicating the pressure adjusting chamber 2 with the fuel tank 3 is provided with a check valve 5 which does not allow liquid material from the fuel tank 3 to flow back to the pressure adjusting chamber 2. A pressure required for pressurizing the fuel tank is obtained by controlling the pressure adjusting bolt 8.

Figures 3A, 3B:
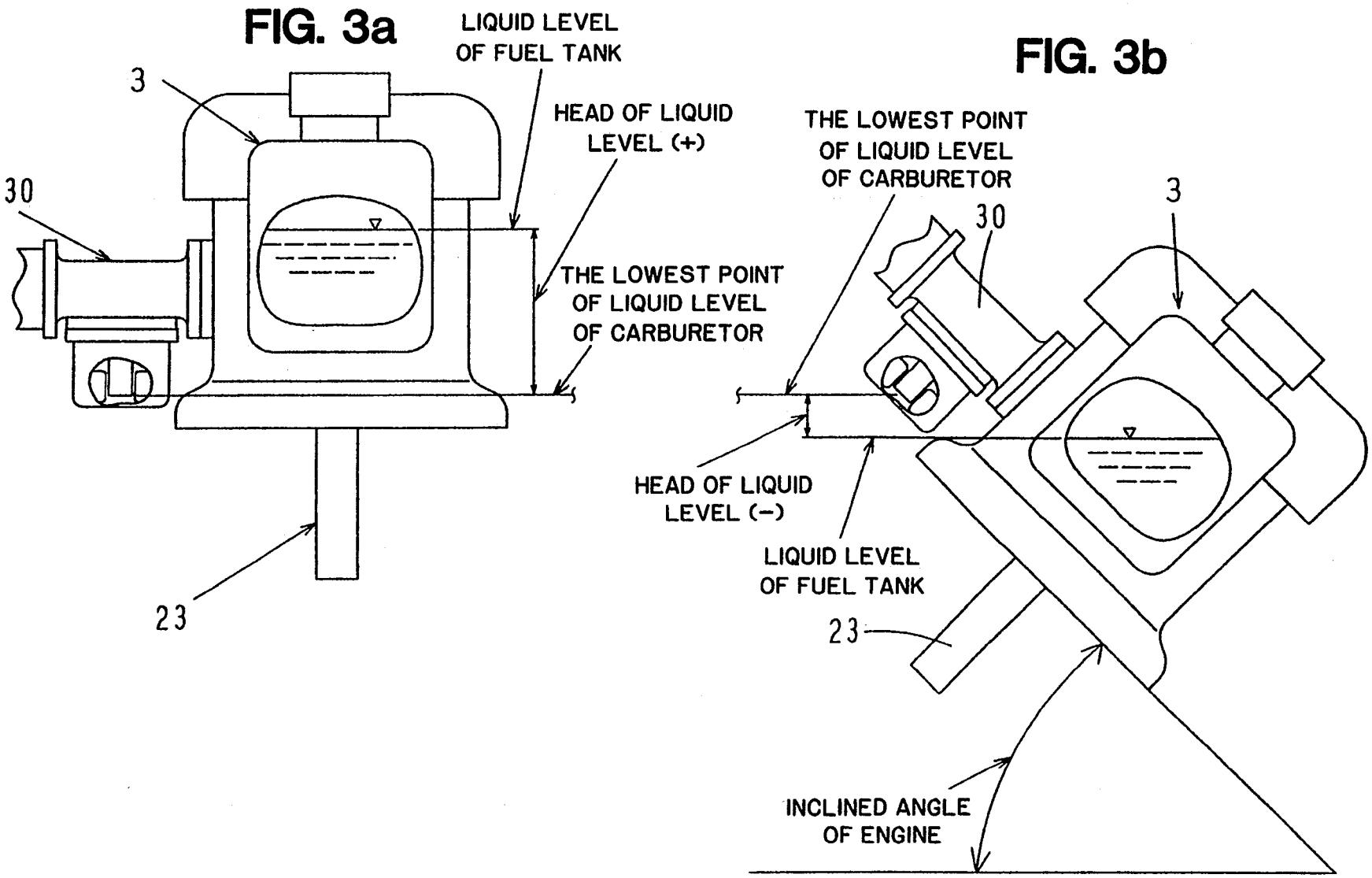
FIGS. 3(*a*) and 3(*b*) are side views of a four-cycle engine when it is operated on a plane and on a slope, respectively.

While a mowing machine is being operated on a slope, as shown in FIG. 3(*b*), a relation between the level of the carburetor 30 and the level of the fuel tank 3 is reverse to that while the mowing machine is being operated on a plane, as shown in FIG. 3(*a*). Therefore, some fuel pressurizing/feeding apparatus is required. In this invention, a positive pressure is introduced into the fuel tank through the passage in the breather device, the pressure adjusting chamber 2 and the pipe 15, and fuel is discharged under a certain pressure, so that the machine can continue the operation even on such a slope without causing troubles such as engine stops.

In order to prevent an increase of the pressure in the fuel tank owing to heating of the tank or such factors and to prevent fuel leakage from the machine even on a steep slope, a vertically elongated space is formed in an upper portion of the fuel tank 3, which space projects from the upper surface of the tank vessel, as shown in the right side of FIG. 1. The pipe 15 of the pipe conduit 4 in communication with the pressure adjusting chamber 2 is connected to an upper portion of the projecting space, and also, a vent hole 6 is formed in this upper portion of the space. A cross-sectional area of the vent hole 6 is set at such a value that a pressure from the pressure adjusting chamber 2 balances with a pressure required for pressurizing the fuel in the fuel tank 3. A pressure adjusting valve may be provided in place of the vent hole 6.

Figure 5:
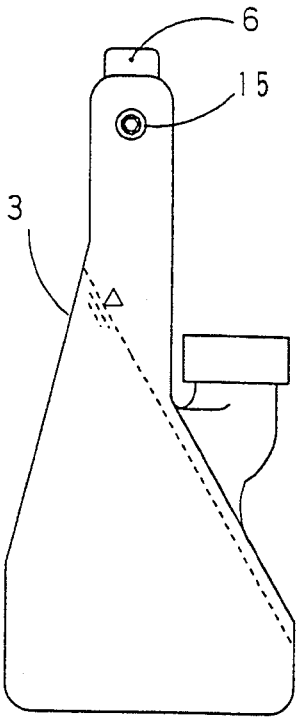
FIG. 5 is a side view of a fuel tank.
Figure 6:
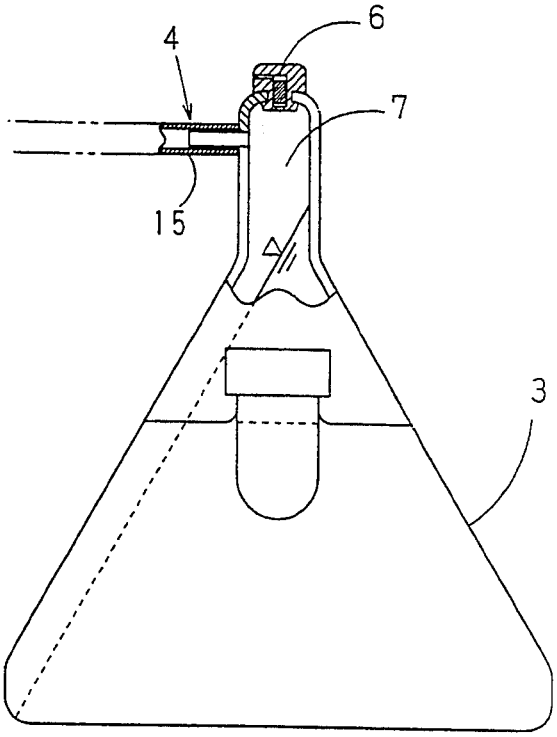
FIG. 6 is a partially broken-away front view of the fuel tank.

An example of the fuel tank 3 having a more effective configuration is shown in FIGS. 5 and 6. As obvious from these drawings, the fuel tank 3 has a substantially triangular shape gradually tapered toward the top, in which a vertically elongated space 7 is defined. Then, as shown in FIG. 1, the pipe 15 of the pipe conduit 4 is connected to this portion, and also, the vent hole 6 is formed if necessary. In this case, the tank has no narrow part, and even if it is inclined, the fuel surface extends along a side surface of the tank, as shown in FIGS. 5 and 6. Consequently, there will hardly be formed an air pocket, which might be formed when the tank having a narrow part, as shown in FIG. 1, is filled with a large amount of fuel and inclined. If an air pocket is formed, expansion of the air causes the fuel to flow back to the pipe conduit 4 or to be discharged from the vent hole 6 dangerously.

An automotive mowing machine of radio control type is the most effective when it is used for operation on a slope which involves a large operational load and is highly dangerous. Although it has been impossible so far to use the conventional mowing machine of this type on a slope at a large inclination angle, the present invention enables such a mowing machine to be used reliably. It is most significant that this invention can provide a fuel pressurizing apparatus which has a light weight, and is compact, highly durable and inexpensive. Besides, one part of the breather device and the pressure in the breather device are utilized for pressurizing the fuel tank, so that the pressurizing apparatus has a simple structure, which results in almost no energy loss.

What is claimed is:

1. A fuel tank pressurizing apparatus comprising:

an engine mounted on a carriage;

a pressure adjusting chamber provided in a breather device of a crank case of said engine;

a pipe conduit provided between said pressure adjusting chamber and a fuel tank so as to connect said pressure adjusting chamber to said fuel tank; and a check valve installed in said pipe conduit so as to prevent fuel from passing from said fuel tank into said pressure adjusting chamber; and wherein one end of said pipe conduit is connected to a vicinity of an upper end portion of a top area which is formed in an upper portion of said fuel tank, said top area projecting from said fuel tank so as to form a projecting space and being smaller in cross-sectional area than said fuel tank.

2. A fuel tank pressurizing apparatus according to claim 1, wherein a pressure adjusting valve is provided in a vicinity of an upper portion of said top area of the upper portion of said fuel tank, and said pressure adjusting valve is set to maintain balance of a pressure from said pressure-adjusting chamber with a pressure required for the fuel tank.

3. A fuel tank pressurizing apparatus according to claim 1, wherein a vent hole is provided in the vicinity of an upper portion of said top area of the upper portion of said fuel tank, and a cross-sectional area of the vent hole is set to maintain balance of a pressure from said pressure adjusting chamber with a pressure required for the fuel tank.

4. A fuel tank pressurizing apparatus according to claim 1, wherein said fuel tank has a substantially triangular shape gradually tapered toward the top, in which the top area is defined.

* * * * *